US006329900B1

(12) United States Patent
Everett

(10) Patent No.: US 6,329,900 B1
(45) Date of Patent: Dec. 11, 2001

(54) RESISTOR ELEMENTS

(75) Inventor: Russell Everett, Norfolk (GB)

(73) Assignee: Cressall Resistors Ltd. (GB)

( * ) Notice: Subject to any disclaimer, the term of this patent is extended or adjusted under 35 U.S.C. 154(b) by 0 days.

(21) Appl. No.: 09/381,433

(22) PCT Filed: Mar. 19, 1998

(86) PCT No.: PCT/GB98/00826

§ 371 Date: Sep. 16, 1999

§ 102(e) Date: Sep. 16, 1999

(87) PCT Pub. No.: WO98/41996

PCT Pub. Date: Sep. 24, 1998

(30) Foreign Application Priority Data

Mar. 19, 1997 (GB) ..... 9705718

(51) Int. Cl.[7] ..... H01C 10/16

(52) U.S. Cl. ..... 338/316; 338/280; 338/289; 338/290; 338/295; 338/317

(58) Field of Search ..... 338/279, 281, 338/280, 289, 290, 291, 287, 288, 315, 316, 317, 295, 304, 305

(56) References Cited

U.S. PATENT DOCUMENTS

| | | | | |
|---|---|---|---|---|
| 1,413,001 | * | 4/1922 | Brooks | 338/280 |
| 1,657,507 | * | 1/1928 | Keene | 338/195 |
| 1,901,499 | * | 3/1933 | Fahrenwald | 373/130 |
| 2,874,257 | * | 2/1959 | Kuhn et al. | 338/58 |
| 2,921,172 | * | 1/1960 | Hackman | 338/316 |
| 3,624,581 | * | 11/1971 | Owen | 338/57 |
| 3,697,923 | * | 10/1972 | Griffes | 338/280 |
| 3,798,417 | * | 3/1974 | Bittner | 219/532 |
| 4,075,459 | * | 2/1978 | Lieber | 338/316 |
| 4,147,888 | * | 4/1979 | Sato | 338/304 |
| 4,151,398 | * | 4/1979 | Maake | 219/532 |
| 4,316,172 | * | 2/1982 | Luy | 338/280 |
| 4,337,390 | * | 6/1982 | Best | 338/195 |
| 4,398,082 | * | 8/1983 | Johannsen | 392/365 |
| 4,553,126 | * | 11/1985 | Brandstater et al. | 338/319 |
| 4,559,631 | * | 12/1985 | Moller | 373/130 |
| 4,651,124 | * | 3/1987 | Kirilloff et al. | 338/280 |
| 4,651,125 | * | 3/1987 | Harkness | 338/295 |
| 5,029,231 | * | 7/1991 | Carr et al. | 338/315 |
| 5,304,978 | | 4/1994 | Cummins et al. . | |
| 5,488,334 | * | 1/1996 | Wolk | 338/316 |
| 5,686,880 | * | 11/1997 | Cummins et al. | 338/316 |

FOREIGN PATENT DOCUMENTS

| | | |
|---|---|---|
| 26 34 283A1 | 2/1978 | (DE) . |
| 0 101 623A1 | 2/1984 | (EP) . |
| 0 649 768 A1 | 4/1995 | (EP) . |
| 33696 | 10/1930 | (GB) . |
| 535157 | 3/1941 | (GB) . |
| 551452 | 6/1943 | (GB) . |
| 557794 | 12/1943 | (GB) . |
| 592635 | 9/1947 | (GB) . |
| 657084 | 9/1951 | (GB) . |
| 675337 | 7/1952 | (GB) . |
| 841132 | 7/1960 | (GB) . |
| 1028842 | 5/1966 | (GB) . |
| 2 323 479 A | 9/1998 | (GB) . |

* cited by examiner

*Primary Examiner*—Karl D. Easthom
(74) *Attorney, Agent, or Firm*—Watts, Hoffmann, Fisher & Heinke Co., L.P.A.

(57) ABSTRACT

A multielement resistor may be assembled into a matrix from a plurality of resistor elements (12) of a U shape construction. The elements (12) are suspended from their upper portions by connecting brackets (16) which are supported by a supporting frame (14). Connecting brackets are preferably of electrically conducting material and insulated from supporting frame (14). Power input/output brackets (18) are provided. The elements (12) are supported at their upper parts and hang from the frame (14) and brackets (16) so that they may expand in a vertical direction due to changes in temperature

9 Claims, 5 Drawing Sheets

RESISTOR ELEMENTS

The present invention relates to resistors and also to resistor elements joined together to form a resistor.

Resistors are used in many applications and are frequently designed for modular construction in order to enable the desired resistor value or power handling capabilities to be achieved.

Examples of applications of resistors of the type described herein are neutral earthing resistors or test resistors. In neutral earthing resistors a small current may be carried all the time the circuit in which the resistor is connected is in operation. In the event of an earth fault or circuit failure the resistor is required to safely carry large amounts of current usually for a few seconds until the other safety devices incorporated in the circuit can operate.

One of the significant problems with neutral earthing resistors is providing a construction with the ability to dissipate in a controlled manner the heat generated in passing high currents.

Resistors all suffer from problems arising from a temperature increase, for example thermal expansion. The extent of the thermal expansion would depend upon the nature of the material and the temperature rise experienced by the material. In some cases the temperature rise can be significant, so too can the thermal expansion. Controlling the resistive qualities of a resistor over a wide temperature range, and also restraining and supporting the resistor elements when they expand thermally is a difficult problem. This is particularly difficult because in most cases the dimensions of the resistor element will change with temperature and the resistivity also changes with temperature.

According to the present invention there is provided a resistor element including an elongate length of electrical resistance material, the element being supported at or near an end portion by support means and arranged such that the element is suspended substantially vertically, said support means arranged to permit the unsupported part of the element to move in a substantially vertical direction.

A particular advantage of the present invention is that the resistor element is supported by its upper end and allowed to hang vertically so that it may move freely from its supporting means in a vertical direction. The thermal expansion will tend to be in a vertical direction and thus subject to the force of gravity along its axial length. This tends to keep the resistor elements straight so preventing the problems that arise from their twisting and distortion, as can occur in other arrangements.

Resistor elements are frequently grouped together in large numbers to form a resistor matrix. Since they all hang vertically the risk of resistors expanding, then distorting and so contacting one another causing a short circuit are significantly reduced.

According to the second aspect of the present invention, there is provided a resistor including at least two resistor elements, each element including a generally elongate length of resistor material, each element being suspended by support means and suspended in a substantially vertical orientation and supported at or near an upper part of the element so that the element may move in a substantially vertical direction, the elements being connected together by electrically conducting means.

A further advantage of this invention is the provision of a resistor to provide both the appropriate resistor value and the thermal capacity, by use of a plurality of resistor elements. By having many elements close together and suspending them vertically as provided for in the present invention, the problems arising from elements distorting or sagging either during or as a result of a repeated heating and cooling is minimised. The resistor elements all tend to expand primarily in a length wise direction. Normally the surrounding enclosure will be sufficiently large that there is a minimal risk of the elements contacting each other and generating a short circuit. The spacing requirements are normally governed by the voltages being handled and the requirement to have a margin for a protection against electrical creepage caused by accumulated dust being able to generate a conduction path to earth.

In a neutral earthing or test resistor this is particularly advantageous because a large current may be passed very suddenly and over a short period of time. In these circumstances the heat builds up in the resistor very quickly. In such conditions the individual resistor elements are more likely to twist and buckle, with a consequently deleterious effect on the long term life of the resistor. In the present invention the resistor elements all expand primarily in a longitudinal fashion, this helps to keep them straight since they need only be suspended from one point and any expansion can be assisted by gravity. The arrangement also facilitates the gradual dissipation of the heat over a period of time.

In a matrix comprising a plurality of resistor elements all of which are linked together to form a single resistor, the components used to connect the individual elements together are sized and dimensioned such that they provide paths of negligible resistance between the individual resistor elements and therefore are not a component which should be a source of local heat or stress. This can be achieved, of course, by appropriate selection of material as well as dimensioning of the structure.

The invention will now be described in great detail with reference to the accompanying drawings in which.

Figure 1:
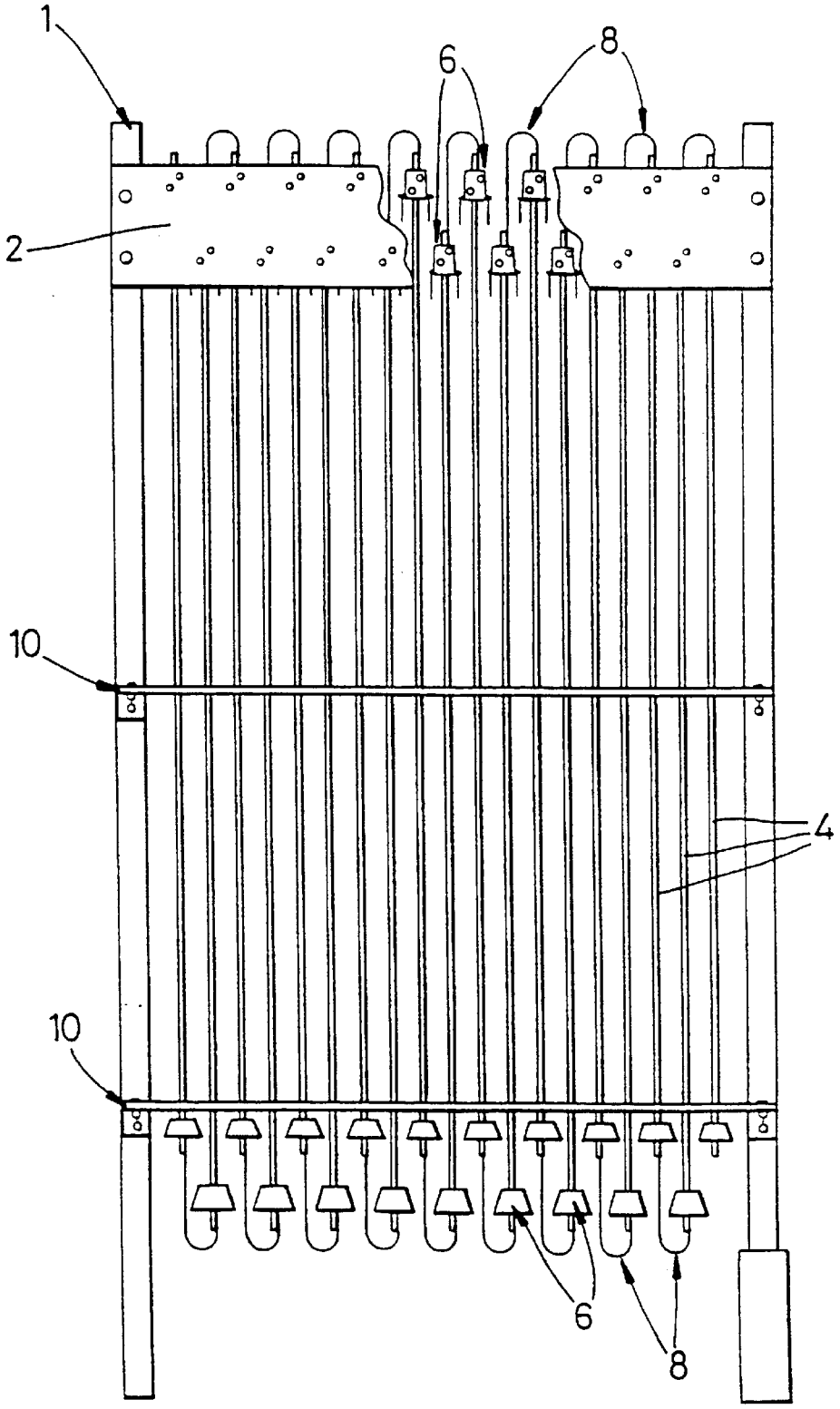
FIGS. 1 and 1A show alternative arrangements for a resistor matrix including a plurality of resistor elements.
Figure 1A:
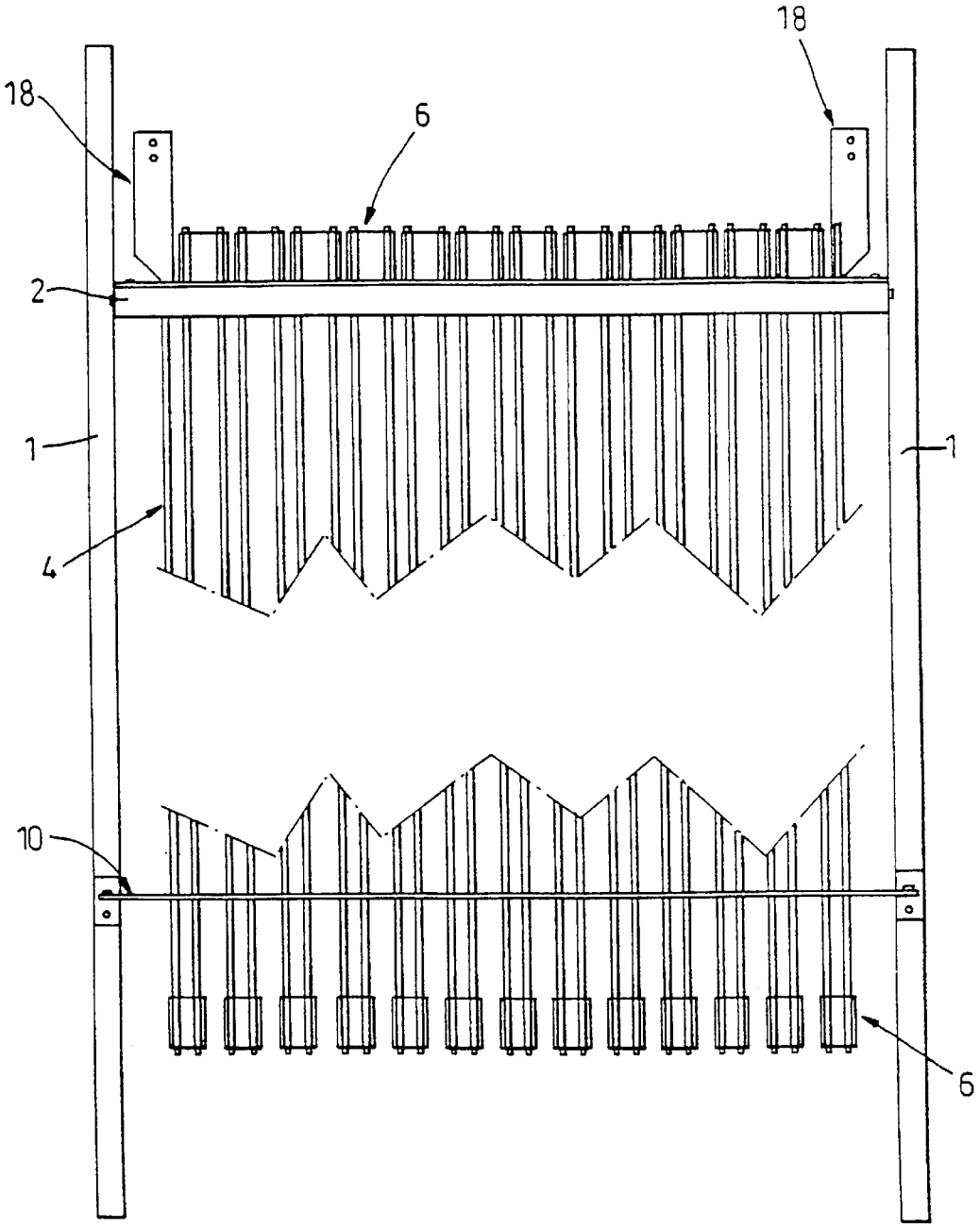

FIG. 1 shows a resistor support frame 1 with an element supporting board 2 supporting a plurality of resistor elements 4. The resistor elements 4 are arranged substantially vertically. At or near the top of the resistor element 4 is a supporting bracket 6 which is secured to the resistor element 4 by known means such as screw clamps, riveted construction or welding. The supporting brackets 6 are designed so that they may be mounted on the supporting board 2. Supporting board 2 is made from any suitable insulating material and will ensure the individual resistor elements are insulated from one another. Individual elements are connected together by connector straps or wires 8. The connector wires will normally be made of low resistivity material and secured to the resistor elements by known means. In order to limit the horizontal movement of the resistor elements 4, restraining supports 10 are connected to the support frame 1.

The restraining supports 10 have holes in them for the resistor elements 4 to pass through, and may be made of insulating material. Alternatively they may be made of an electrically conducting material and have holes or slats of sufficient size to accommodate the necessary electrically insulating material which is placed between the resistor elements 4 and support bars 10.

Normally a pair of the support frames 1 are connected together with a pair of supporting boards 2 and supporting brackets 6 are secured to the boards 2 to form a matrix. The matrix is enclosed in a protective housing. The housing is intended to provided safety protection from the high voltages of the circuit and from the high temperatures which may arise as a result of a circuit fault heating the resistor elements.

In operation the resistor elements are mounted in a vertical or substantially vertical orientation as shown. The input and output leads are connected to resistor elements at different ends of the frame in known manner (not shown). When a fault current passes through the resistor elements they will be heated rapidly, as a result they will expand. The vertical suspension arrangement of the resistor element permits their expansion in a downward direction because they are only suspended all or near their upper portions by supporting brackets 6.

Figure 2:
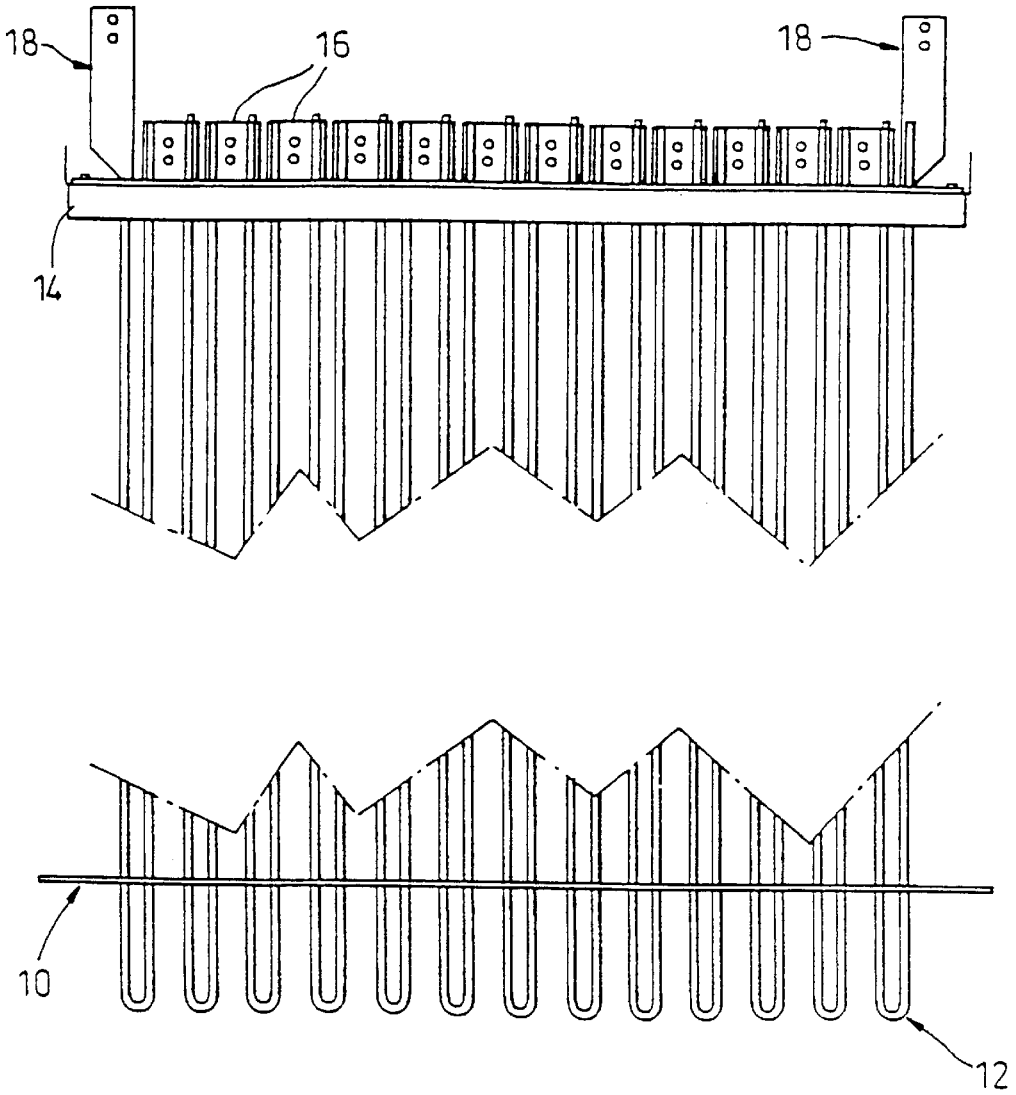
FIG. 2 shows a resistor matrix with a plurality of U shaped resistor elements.

FIG. 2 shows another embodiment of the invention. In this embodiment the resistor elements 12 are formed into U shaped resistor elements. These resistors elements may be of the same or a similar material to the resistor elements shown in FIG. 1 but are formed into a U shape, with the free ends of the U upper most. A supporting frame 14 is used to support the U shaped elements 12. The supporting frame 14 is made from an insulating material and has a number of slots in it. The slots are sufficiently large for the resistor elements to pass through and allow room for thermal expansion and some tolerance. Connecting brackets 16 are designed to connect together adjacent resistor elements 12 and support them in support frame 14. Each connecting bracket 16 is secured to one arm of two adjacent U shaped elements 12. The bracket may be secured by clamps, screws, welds, or other known means. Because the clamps are of greater size than the slots the arms of the resistor elements 12 pass through the slot and rest on top of the frame 14. Because the resistor elements 12 are secured to the brackets 16 they are then supported by the frame 14. The clamping brackets 16 also provide an electrical conducting path from one element 12 to the next and are of size and material intended that they are of such a resistance that they are not a source of heat when the device is in use.

Alternatively, the supporting frames 14 may be made from a metal material and have appropriate insulation secured to them. The frames 14 could use a U or channel section made from a metal to provide the required strength, with the insulation material resting in the channel or engaging it in a way which limits its movement and that of the resistor elements.

Electrical input and output connectors 18 are mounted near an end of the supporting frame 14 and used for providing electrical connections (inputs and outputs) to the resistor elements 16. In this example the current flows into a first resistor element 12, around the U shaped resistor element, through connector element 16 Into the next resistor element 12 and on through the entire matrix. The U shaped elements are suspended at their upper ends and allowed to move freely downwards in response to the thermal expansion arising from carrying a current. Horizontal restraining supports 10 are used to limit the amount of horizontal movement allowed. This is important to prevent the resistor elements touching one another, with the consequent risk of changing, the electrical resistance.

Figure 3:
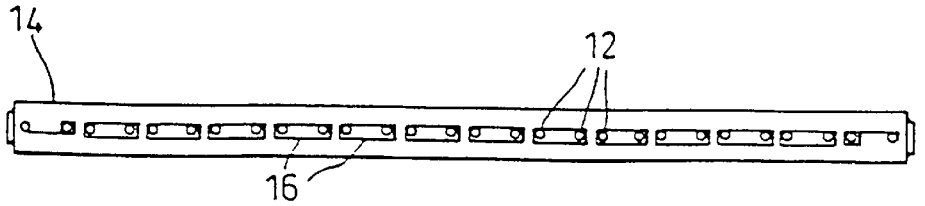
FIGS. 3 and 3A show plan views of an element supporting a matrix.

FIG. 3 is a plan view of a supporting frame 14 of FIG. 2. As explained above, the supporting frame is provided with holes or slots which the resistor elements pass through The resistor elements are supported in the frame 14 by the connecting brackets 16, which prevent them dropping down through the supporting frame.

Figure 3A:
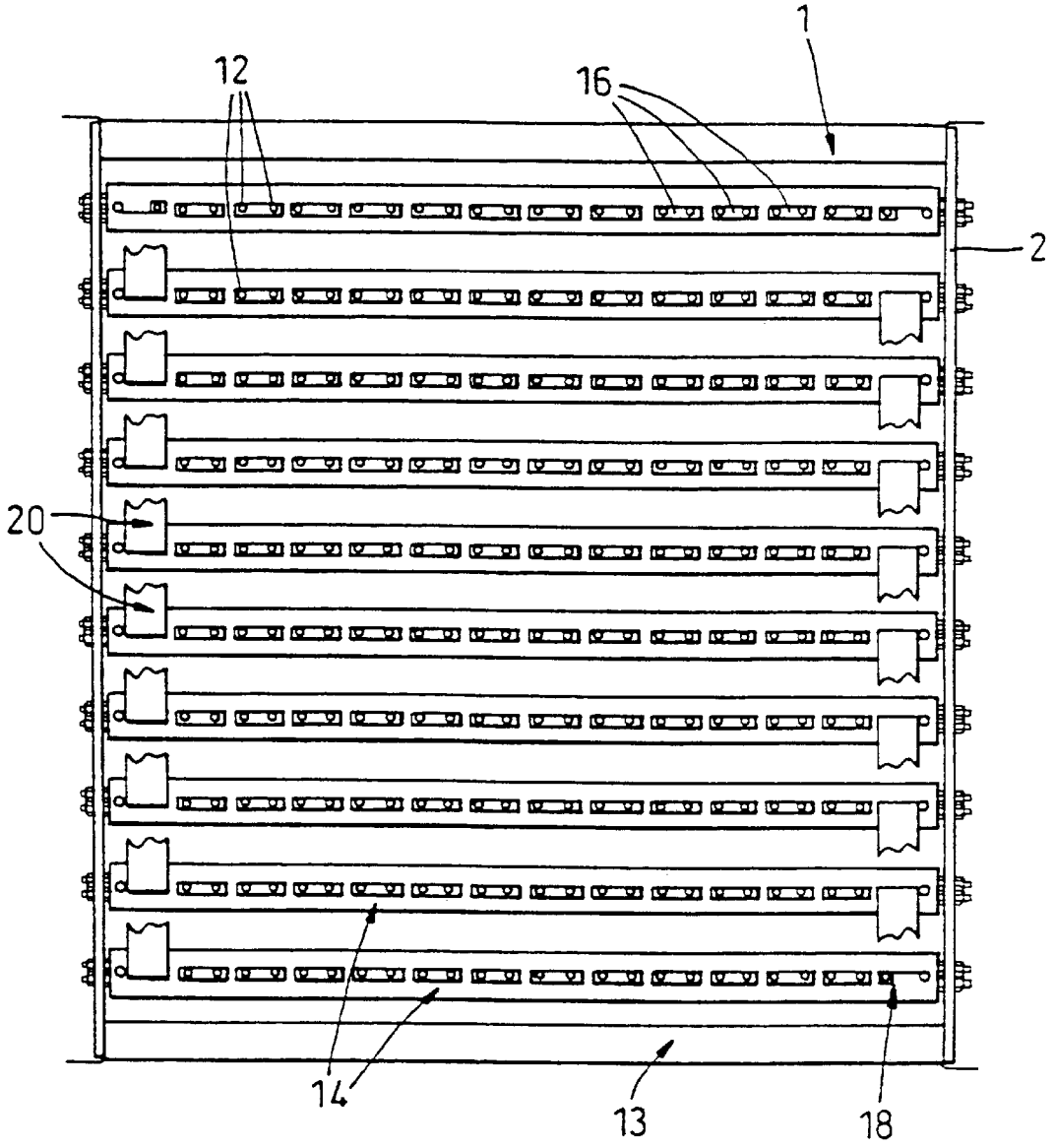

FIG. 3A shows a plan view of a resistor. A resistor includes a number of elements mounted in the manner described below.

A resistor support frame 1 and supporting boards 2 are secured together to provide support for the supporting frames 14. The supporting frames 14 support individual resistor elements 12. Resistor elements 12 pass through slots in the frames 14 in the manner described above. Input/Output brackets 18 are provided for connection to provide current input and output paths. Individual support frames 14 may be connected together electrically by strap means 20.

Figure 4:
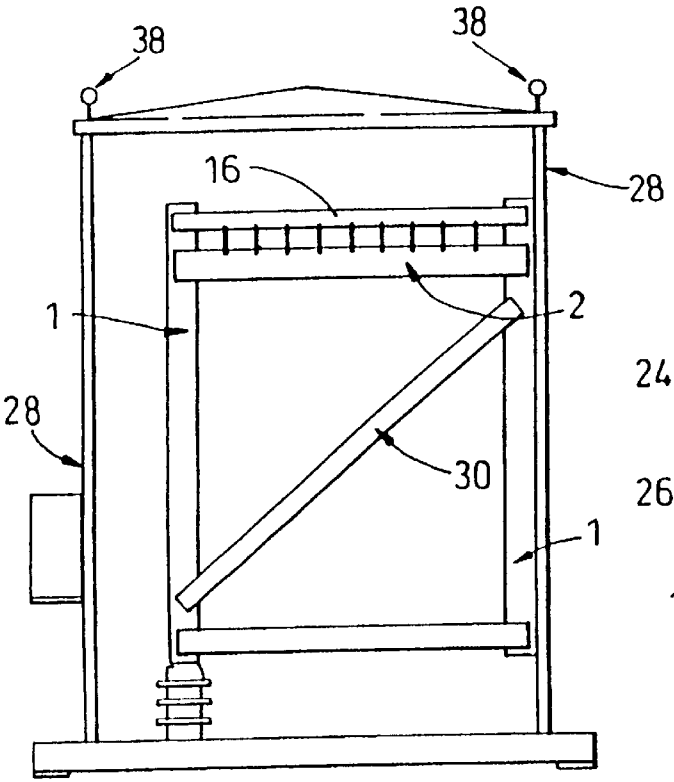
FIG. 4 shows a side elevation of a container for containing a resistor.

FIG. 4 shows a side elevation of a neutral earthing resistor container 28. The resistor matrix is preferably located inside the container 28 means which provides adequate ventilation for cooling purposes and ensures adequate spacing of the resistor elements from one another to ensure electrical isolation in all circumstances. The figure shows a side elevation with a support frame 1 on which are located further supporting boards 2; resting on these are connector brackets 16 supporting the resistor elements 12 (not shown). The whole structure May be lifted by lifting eyes 38.

Figure 5:
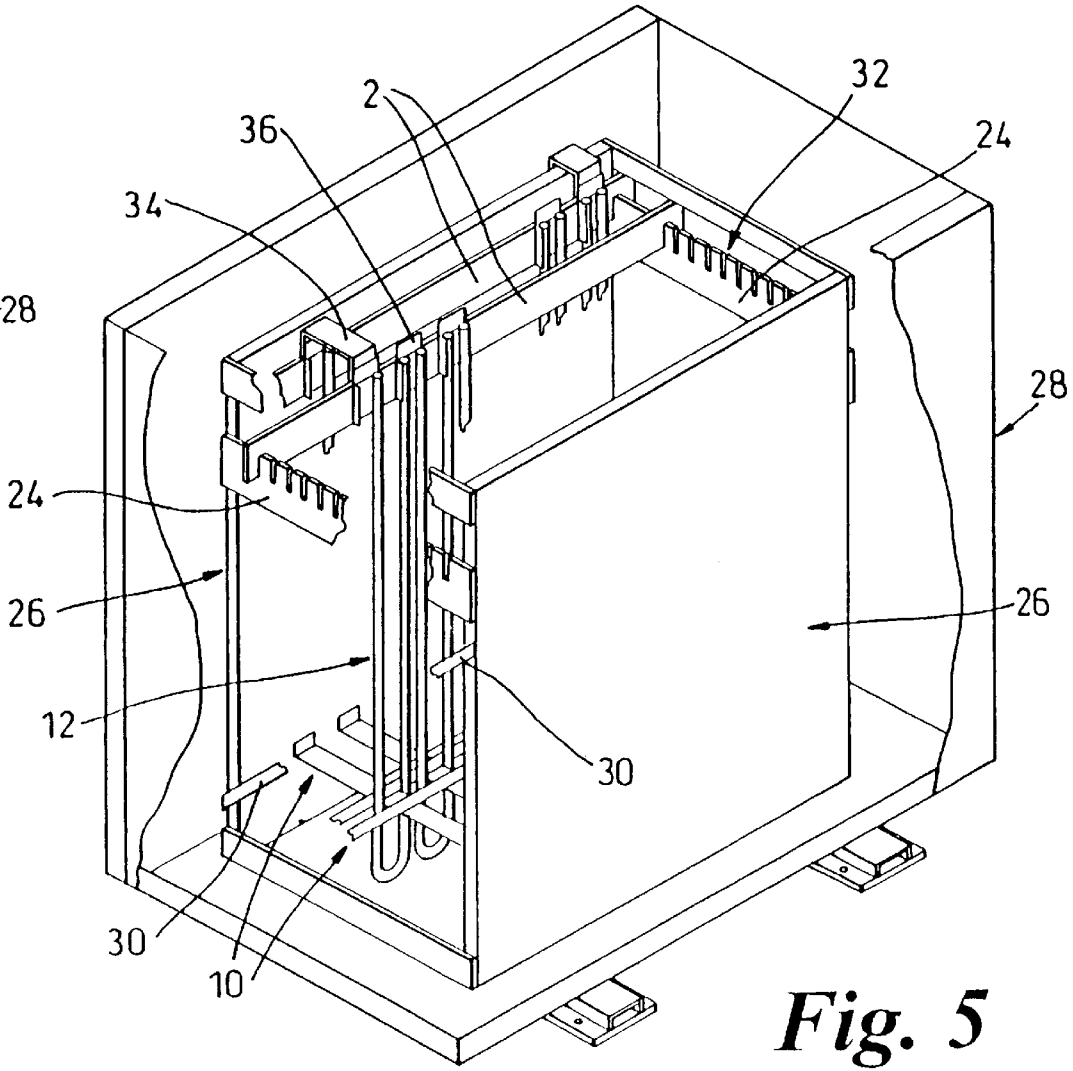
FIG. 5 is a cut away perspective view of one alternative construction of a resistor assembly.

FIG. 5 shows a cut away perspective view of an alternative resistor matrix. The whole matrix is surrounded by a protective enclosure 28. Enclosed within the protective enclosure is the neutral earthing or test resistor. For convenience the whole resistor is herein referred to as a resistor matrix because the individual elements are arranged in rows and columns as explained below.

The matrix has 2 side walls 26, attached to the ends are two mounting rails 24. This structure may have its strength enhanced by bracing struts 30. The mounting rails 24 support element supporting boards 2. A plurality of supporting boards 24 are mounted on the rails 24. Their location may be seen by locating notches 32 which can be seen in the figure. A number of interboard straps 34 are used to restrict the movement of supporting boards 2. They can also conveniently be used to provide electrical connections between the supporting boards.

Mounted on the supporting boards 2 are element supporting and connecting brackets 36 which are used to clamp the U shaped resistor elements in place. Preferably the supporting boards 2 are made from an insulating material, in which case the electrical path across the support board passes from an input/output bracket (not shown) along a U shaped resistor elements 12 across the connecting bracket 36, into the next U shaped resistor element, through the resistor element into the next connector bracket 36 and so on.

Restraints against horizontal movement are provided by horizontal restraining supports 10. These may be made of insulating material and have slots, guides or other locating means in them to locate the resistor elements and restrict their movement. Alternatively, the supports 10 may be made from conducting material and have insulation on or around them such that the resistor elements 12 do not come into contact with the support elements.

Spacing of the mounting rails 24 and supporting frames is such as to permit thermal expansion and provide adequate cooling space between the resistor elements, and also to ensure sufficient distance to maintain electrical insulation.

Normally these resistor matrices are used as neutral earthing resistors. Because in these applications it is necessary to pass large amount of current, but only for a short time, it is necessary to be able to absorb a large amount of energy very rapidly.

It is desirable to ensure a safe and controlled dissipation of the accumulated energy. Preferably the outer easing of the resistor should not be too hot to be damaged or a hazard to surrounding equipment. It is also desirable that the energy be dissipated in a controlled manner. In contrast to normal resistors in which the aim is to dissipate the heat as rapidly as possible and avoid a temperature rise, the resistors of the present invention aim to provide a rapid and safe absorption of energy, which is achieved by a steep temperature rise. The loss of this energy should be slow and controlled. The surface area is therefore reduced to a minimum by making the resistor elements of circular cross-section. The thermal expansion will be principally in the longitudinal direct on since the resistor elements are suspended vertically from their top portion so that they may move freely in the vertical direction to expand and contract as necessary. The vertical arrangement helps ensure a gradual cooling of the whole element.

Temperature rises for these resistors can be significant. For cast metals the temperature can be allowed to rise to about 500° C. for most stainless steels the maximum temperature is about 760° C. Clearly this represents a considerable rise and special insulating materials may be needed to tolerate the very high temperature variations. Additionally the nature of the protective enclosure has also to be carefully designed to ensure steady gradual cooling but not excessive or rapid heat transfer to the surroundings in a way which may damage surrounding equipment.

A typical matrix will have an area of approximately 1 sq. m. The individual resistor elements in a matrix may be of different sizes, and are typically of 8 or 12 mm in diameter. Clearly hexagonal or octagonal bar could be used to provide a desired cross sectional area. Typically, the elements will be 1.5 m or so long. Cast metals may be used but stainless steel alloys are generally to be preferred. Clearly the dimensions of the individual elements will depend upon the resistive value of the material used, the total resistance required and the thermal properties of the materials as well as the environment in which they are operating.

The description above relates primarily to a resistor consisting of a matrix of rods which are connected in series. This series connection is the preferred arrangement for neutral earthing resistors, however, other arrangements are equally possible and may be in some circumstances preferable.

It may be preferable to have a mixture of series and parallel connections for the resistor elements to meet the particular resistance value and energy dissipation requirements.

Practically this could be achieved by connecting several adjacent filaments in parallel and then connecting them, collectively, in series to another set of filaments which would also be connected in parallel with one-another.

For example, consider a resistor bank supporting a quantity of say, 12 filaments in a grid of 3×4 filaments. For some applications, one would connect these 12 filaments in series. But for other applications it might be preferable to connect the 12 filaments in 3 parallel paths. To do this, one could connect the following adjacent filaments in parallel:

1, 2 & 3

4, 5 & 6

7, 8 & 9

10, 11 & 12

Each of these groups could then be connected in series. In practice there are many ways of arranging for the connections to be made. For example, the connector elements 16 could be made longer so that they connect several conductor elements (6, 12) together. The groups of parallel connected conductors can then be coupled together in series as indicated above.

It is possible that these parallel connected filaments or elements could be substantially thinner than the elements that would be connected in series. If these filaments or elements are likely to need greater support to enable them to maintain their substantially-vertical posture. Metallic (electrically conducting) links can be used between the filaments to support them against one-another when elements connected in parallel, because there is no electrical potential between the elements.

These metallic links providing support between resistive elements might be in the form of substantially horizontal metallic rods clamped, bolted or welded between the resistor elements.

Alternatively, the resistor elements (6, 12) and the metallic bracing between them might be formed from a single sheet of resistor material which is punched or even slit and then stretched, to produce individual resistor elements which are interconnected to one another for their mutual support.

Whatever method of manufacture or construction is used, the end result at least is that some of the resistor elements are connected in parallel with one-another and are interconnected for their mutual support.

This matrix of parallel-connected and interconnected resistor filaments might have the appearance of curtains of mesh or net which are suspended from their top edges. Advantageously, the single sheet of resistor material would be a preferred method of manufacture. The sheet could be slit (not punched) and then stretched to produce a "diamond" mesh pattern. Using this method of construction, the current-carrying elements would be substantially vertical as they are described above but, individually, they would have the appearance of zig zag conductors that are interconnected and suspended from their upper ends. Thermal expansion would still occur substantially in the vertical direction. Additionally there would be some, but a relatively small amount of sideways expansion.

Spacing between elements will vary according to the voltage loading requirements of the resistor matrix. It is necessary to ensure sufficient distance between the elements and connectors to ensure the insulating properties are preserved against electrical creepage arising from an accumulation of dirt over many years of service. It is also important to recognise some of the environments may be very hostile and dusty. Normally such resistors run cold, but by suspending them vertically they may expand, if necessary, and the gravitational force may be used to help them expand and to keep them straight and so minimize any problems of thermal distortion. In certain applications and under certain conditions expansions of 3.5–4.5 cm have been measured.

References have been made to insulating material in general but those required in this type of application will normally be mica based or ceramic, insulators to enable them to withstand the very high temperatures which may be experienced when a resistor of this type comes into use.

Whilst in this description vertical has been used to indicate the orientation in which the resistor elements are suspended, it should be understood that the invention will work perfectly well if the elements are suspended a few degrees from the vertical.

What is claimed is:

1. A neutral earthing resistor for carrying large currents in short time periods, the resistor comprising a plurality of elongated resistor elements having legs and ends, a laterally extending support frame comprising insulating material said support frame having a plurality of through-holes or through-slots for receiving an end of each of said resistor elements, at least one laterally extending restraining support, spaced from said support frame, and having a plurality of through-holes or through-slots for receiving said legs of said resistor elements, said restraining support comprising insulating material and being for limiting lateral movement of said resistor elements, connecting brackets for electrically connecting adjacent ends of adjacent resistor elements and for supporting said resistor elements on said support frame, wherein said connecting brackets rest on insulating material on one side of said support frame and said resistor elements extend through respective holes or slots in said supporting frame to the other side of said support frame, and extend through said holes or slots in said restraining support, so that the resistor elements are suspended in a substantially vertical orientation, whereby the resistor elements are permitted to expand freely in a vertical direction.

2. A resistor as claimed in claim 1 wherein said laterally extending restraining support is made of electrically conducting material and includes said electrically insulating material between the electrically conducting material and the resistor elements.

3. A resistor as claimed in claim 1 wherein the resistor elements are substantially U-shaped, and each element is supported by said connecting brackets which are connected to the ends of the U-shape.

4. A resistor as claimed in claim 3 wherein the resistor elements are formed of rods, bars or filaments.

5. A resistor as claimed in claim 4 wherein the resistor elements are of circular cross-section.

6. A resistor as claimed in claim 4 wherein the resistor elements are of hexagonal or octagonal cross-section.

7. A resistor as claimed in claim 1 wherein the resistor elements are formed of rods, bars or filaments.

8. A resistor as claimed in claim 7 wherein the resistor elements are of circular cross-section.

9. A resistor as claimed in claim 1 comprising a plurality of resistor elements, wherein some of the resistor elements are connected in series and some are connected in parallel.

* * * * *